US007215312B2

(12) United States Patent
Kumagai et al.

(10) Patent No.: US 7,215,312 B2
(45) Date of Patent: May 8, 2007

(54) SEMICONDUCTOR DEVICE, DISPLAY DEVICE, AND SIGNAL TRANSMISSION SYSTEM

(75) Inventors: Masao Kumagai, Kawasaki (JP); Shinya Udo, Aichi (JP)

(73) Assignee: Fujitsu Limited, Kawasaki (JP)

( * ) Notice: Subject to any disclaimer, the term of this patent is extended or adjusted under 35 U.S.C. 154(b) by 195 days.

(21) Appl. No.: 10/427,547

(22) Filed: Apr. 30, 2003

(65) Prior Publication Data

US 2003/0218588 A1 Nov. 27, 2003

(30) Foreign Application Priority Data

May 24, 2002 (JP) ..... 2002-149929

(51) Int. Cl.
*G09G 3/36* (2006.01)

(52) U.S. Cl. ..... 345/98; 345/100

(58) Field of Classification Search ..... 345/87–100, 345/204

See application file for complete search history.

(56) References Cited

U.S. PATENT DOCUMENTS 6,862,015 B2 * 3/2005 Fujioka et al. ..... 345/98
2001/0048415 A1 12/2001 Morii

FOREIGN PATENT DOCUMENTS

| | | |
|---|---|---|
| JP | 2001-166750 | 6/2001 |
| JP | 2001-202052 A | 7/2001 |
| JP | 2001-265288 A | 9/2001 |
| JP | 2002-55663 | 2/2002 |

* cited by examiner

*Primary Examiner*—Regina Liang
(74) *Attorney, Agent, or Firm*—Greer, Burns & Crain, Ltd.

(57) ABSTRACT

A display device includes a plurality of data drivers which are cascade-connected, and prevents variation of the duty ratio of a signal caused by accumulation of errors. In each of the plurality of data drivers: a first input circuit receives a first signal supplied from outside; a second input circuit receives a second signal supplied from outside, in response to the first signal received by the first input circuit; a signal processing circuit performs signal processing based on the second signal received by the second input circuit; a first output circuit inverts the first signal received by the first input circuit, and outputs the inverted first signal; and a second output circuit delays the second signal received by the second input circuit, by a predetermined amount, and outputs the delayed second signal.

7 Claims, 19 Drawing Sheets

SEMICONDUCTOR DEVICE, DISPLAY DEVICE, AND SIGNAL TRANSMISSION SYSTEM

CROSS-REFERENCE TO RELATED APPLICATIONS

This application is based upon and claims the benefits of priority from the prior Japanese Patent Application No. 2002-149929, filed on May 24, 2002, the entire contents of which are incorporated herein by reference.

BACKGROUND OF THE INVENTION

1) Field of the Invention

The present invention relates to a semiconductor device, a display device, and a signal transmission system. In particular, the present invention relates to a semiconductor device which is cascade-connected and processes signals, and a display device and a signal transmission system which include a cascade connection and processes signals.

2) Description of the Related Art

For example, in liquid crystal display (LCD) devices, pixels each including a transistor are arranged in rows and columns, gate bus lines extending in the horizontal direction are connected to gates of the transistors in the pixels, and data bus lines extending in the vertical direction are connected to capacitors in the pixels through the transistors. When data is displayed on an LCD panel, a gate driver sequentially drives each gate bus line on a line-by-line basis so as to bring transistors connected to the gate bus line into conduction, and then data drivers simultaneously write data into pixels on the line in the horizontal direction through the conducting transistors.

In the conventional constructions, LCD drivers are commonly connected to buses which propagate display-data signals, a clock signal, and the like. In such constructions, signal wires intersect, and therefore the number of mounted circuit board layers becomes great. In order to decrease the number of mounted circuit board layers, the LCD drivers are cascade-connected so that outputs of each LCD driver are supplied to another LCD driver in the following stage.

Since LCD drivers are connected in series in the cascade connection, mounted signal wires do not intersect, and therefore the number of mounted circuit board layers can be decreased. Thus, the circuit boards can be manufactured at low cost.

FIG. 9 is a diagram illustrating an example of a conventional LCD device having a cascade-connected construction. The LCD device of FIG. 9 comprises an LCD panel 10, a control circuit 11, a gate driver 12, data driver ICs 13, and signal lines 15.

In the LCD panel 10, pixels each including a transistor (not shown) are arranged in rows and columns, gate bus lines extending from the gate driver 12 in the horizontal direction are connected to gates of the transistors in the pixels, and data bus lines extending from the data driver ICs 13 in the vertical direction are connected to capacitors in the pixels through the transistors. When data is displayed on the LCD panel 10, the gate driver 12 sequentially drives each gate bus line on a line-by-line basis so as to bring transistors connected to the gate bus line into conduction, and then the data driver ICs 13 simultaneously write data through the conducting transistors into pixels on each horizontal line in the horizontal direction.

The control circuit 11 is a circuit which controls the gate driver 12 and the data driver ICs 13 so as to display data on the LCD panel 10. Signals outputted from the control circuit 11 are first supplied to the data driver ICs 13 in the first stage, and are then supplied from a data driver IC 13 in each stage to another data driver IC 13 in the following stage.

The gate driver 12 sequentially drives each gate bus line on a line-by-line basis under the control of the control circuit 11 so as to bring transistors connected to the gate bus line into conduction.

The data driver ICs 13 are cascade-connected, and latch data which are supplied from the control circuit 11 and are to be displayed, in synchronization with a clock signal. The data latched by each data driver IC 13 are supplied to the LCD panel 10 and the next data driver IC 13.

FIG. 10 is a diagram illustrating details of an example of each of the data driver ICs 13. The data driver IC 13 illustrated in FIG. 10 comprises input buffers 20 to 23, a counter 24, a clock control circuit 25, a data control circuit 26, a latch circuit 27, and output buffers 28 to 31.

A start signal (START) is inputted into the input buffer 20, the clock signal (CLOCK) is inputted into the input buffer 21, a reset signal (RESET) is inputted into the input buffer 22, and a data signal (DATA) is inputted into the input buffer 23.

The counter 24 counts clock cycles of the clock signal outputted from the clock control circuit 25. When the count reaches a predetermined value, the counter 24 activates a start signal supplied to the output buffer 28.

The clock control circuit 25 controls the counter 24, the data control circuit 26, and the latch circuit 27 in response to the clock signal supplied from the input buffer 21, the start signal, and the reset signal, and supplies the clock signal to the output buffer 29.

The data control circuit 26 latches the data signal inputted through the input buffer 23, in synchronization with the clock signal supplied from the clock control circuit 25, and supplies the latched data signal to the latch circuit 27.

The latch circuit 27 latches the data signals supplied from the data control circuit 26, and supplies the latched data signals to the LCD panel 10.

The output buffer 28 supplies the start signal outputted from the counter 24, to the next data driver IC 13.

The output buffer 29 supplies the clock signal outputted from the clock control circuit 25, to the next data driver IC 13.

The output buffer 30 supplies the reset signal outputted from the input buffer 22, to the next data driver IC 13.

The output buffer 31 supplies the data signal outputted from the data control circuit 26, to the next data driver IC 13.

FIG. 11 is a diagram illustrating details of an example of the data control circuit 26. In the example of FIG. 11, the data control circuit 26 is comprised of an input circuit 40 and an output circuit 44. The data control circuit 26 latches a data signal in synchronization with a leading edge and a trailing edge of the clock signal, supplies the latched data signals to the LCD panel 10, synthesizes the latched data signals so as to reproduce the data signal, and outputs the synthesized data signal.

The input circuit 40 is comprised of an inverter 41 and data flip-flop (DFF) circuits 42 and 43. The DFF 42 latches the data signal in synchronization with a trailing edge of the clock signal, and the DFF 43 latches the data signal in synchronization with a leading edge of the clock signal. The data signals latched by the DFFs 42 and 43 are supplied to the latch circuit 27 and the output circuit 44.

The output circuit 44 is comprised of inverters 45 and 46 and NAND gates 47 to 49, synthesizes the data signals latched by the DFFs 42 and 43 in synchronization with the clock signal, and outputs the synthesized data signal.

FIG. 12 is a diagram illustrating details of an example of the counter 24. The counter 24 is realized by a shift register constituted by DFFs 50-1 to 50-n and 51 and an inverter 52, where the number of the DFFs 50-1 to 50-n and 51 corresponds to the number n+1 of clock cycles which are necessary for capture of the data signal. The counter 24 has a function of notifying an IC in the following stage of start timing of capture of a clock signal and a data signal supplied from the stage in which the counter 24 is arranged.

Next, the operations of the above conventional example are explained.

When an image signal is inputted into the control circuit 11, the control circuit 11 outputs a reset signal to be supplied to the data drivers IC 13 in the first stage.

Each of the data driver ICs 13 reads in the reset signal through the input buffer 22, and resets the clock control circuit 25 and the counter 24. Thereafter, each of the data driver ICs 13 supplies the reset signal to another data driver IC 13 in the next stage. Consequently, the data driver ICs 13 are reset one after another.

Subsequently, when a clock signal and a data signal are outputted from the control circuit 11, the data driver IC 13 in the first stage reads in the clock signal and the data signal through the input buffer 21 and the input buffer 23 (see FIG. 13. (A) and (B)), and supplies the clock signal and the data signal to the clock control circuit 25 and the data control circuit 26, respectively.

When a start signal is inputted, the DFF 43 in the data control circuit 26 latches the data signal in synchronization with a leading edge of the clock signal, and outputs the latched data signal as a signal A (see FIG. 13, (C)) to the latch circuit 27. On the other hand, the DFF 42 in the data control circuit 26 latches the data signal in synchronization with a trailing edge of the clock signal, and outputs the latched data signal as a signal B (see FIG. 13, (D)) to the latch circuit 27.

The latch circuit 27 latches the data supplied from the data control circuit 26, and supplies the latched data to the LCD panel 10.

After the counter 24 is reset with the reset signal, the counter 24 counts clock cycles of the clock signal. When (n−1)+0.5 cycles of the clock signal elapse, the counter 24 sets the start signal supplied to the output buffer 28, to the "H" state.

The output buffer 29 and the output buffer 31 respectively output the clock signal and the data signal to the next data driver IC 13 (see FIG. 13, (E) and (F)).

As explained above, the data signal outputted from the control circuit 11 is sequentially latched by the data driver ICs 13 in synchronization with the clock signal, and the latched data signals are then supplied to the LCD panel 10.

The gate driver 12 drives each of predetermined gate bus lines on the LCD panel 10 so as to bring transistors on each line into conduction. Thus, data supplied from the data driver ICs 13 are displayed on predetermined lines on the LCD panel 10.

However, in the case where the data driver ICs 13 are cascade-connected, when a signal is inputted into a driver device, the signal is supplied through an output buffer to a driver device in the next stage. At this time, there is a difference in the signal delay in the buffer between a leading edge and a trailing edge of the signal, where the difference is caused by manufacturing processes. Therefore, the duty ratio of the signal at the output stage is slightly different from the duty ratio of the signal at the input stage.

In the case where the data driver ICs 13 having similar delay characteristics are cascade-connected, errors of the duty ratio of a signal which are produced when the signal passes through the respective data driver ICs 13 are accumulated. Therefore, sometimes, the accumulated error of the duty ratio of the signal after the signal passes through the drivers in multiple stages becomes unignorable. For example, in SXGA (Super Extended Graphics Array) LCD panels, ten data driver ICs 13 are cascade-connected. Therefore, there is a possibility that normal shapes of signals cannot be maintained during propagation of the signals through the ten data driver ICs 13 due to the accumulated error in the duty ratio.

FIG. 14 is a diagram illustrating waveforms of the clock signal at the input stages of ten, cascade-connected, data driver ICs 13. As illustrated by reference (A) in FIG. 14, the clock signal has a rectangular shape when the signal is inputted into the first data driver IC 13. However, every time the clock signal passes through a data driver IC 13, the duration of the "H" state is elongated, and the duration of the "L" state is shortened.

That is, the duty ratio of the clock signal varies from the duty ratio of the waveform at the time of input into the first data driver IC 13. Therefore, some data driver IC 13 may not normally operate.

Thus, in Japanese Patent Application No. 2002-19518, the present inventors have proposed an integrated circuit in which errors of the duty ratio are not accumulated by inverting the output of the clock signal at each data driver IC 13.

FIG. 15 is a diagram illustrating details of the LCD device proposed by the above Japanese patent application No. 2002-19518. As illustrated in FIG. 15, the integrated circuit disclosed in the above Japanese patent application comprises an LCD panel 10, a control circuit 11, a gate driver 12, and data driver ICs 16. When compared with the construction of FIG. 9, the data driver ICs 13 are replaced with the data driver ICs 16. As a odd-even switch signal, a GND signal is inputted into each of the odd-numbered ICs, and a VDD signal is inputted into each of the even-numbered ICs. The other portions of the construction of FIG. 15 are identical to FIG. 9.

FIG. 16 is a diagram illustrating details of a construction of each data driver IC 16 in the construction of FIG. 15. The data driver IC 16 of FIG. 16 comprises input buffers 60 to 62, an inverter 63, a signal-inversion switch circuit 64, a clock controller 65, a data controller 66, an internal circuit 67, an inverter 68, a signal-inversion switch circuit 69, an inverter 70, and output buffers 71 and 72.

Next, the operations of the device disclosed in the above Japanese patent application No. 2002-19518 are briefly explained.

Since a GND signal or a VDD signal is inputted into the input buffer 62 according to the position of each data driver IC 16 in the cascade connection, each of the signal-inversion switch circuits 64 and 69 selects one of two terminals according to the state of the signal inputted through the input buffer 62.

FIG. 17 is a diagram illustrating the connection state in each of the odd-numbered data driver ICs 16 in the cascade connection. Since the GND signal is inputted as an odd-even switch signal into each of the odd-numbered data driver ICs 16, the signal-inversion switch circuit 64 selects the output of the input buffer 60, and the signal-inversion switch circuit 69 selects the output of the inverter 68, as illustrated in FIG. 17.

FIG. 18 is a diagram illustrating the connection state in each of the even-numbered data driver ICs 16 in the cascade connection. Since a VDD signal is inputted as an odd-even switch signal into each of the even-numbered data driver ICs 16, the signal-inversion switch circuit 64 selects the output of the inverter 63, and the signal-inversion switch circuit 69 selects the output of the clock controller 65, as illustrated in FIG. 18.

Therefore, the clock signal inputted into each of the odd-numbered data driver ICs 16 is supplied as is to the clock controller 65, and is thereafter inverted by the inverter 68. Then, the output of the inverter 68 is output from the data driver IC 16.

On the other hand, the clock signal inputted into each of the even-numbered data driver ICs 16 is inverted by the inverter 63, and is then supplied to the clock controller 65. Thereafter, the inverted clock signal is output as is from the data driver IC 16.

Consequently, even if the duration of the "H" state of the clock signal is elongated, the clock signal is inverted when the clock signal passes through the clock controller 65 in each data driver IC 16, as illustrated in FIG. 19. Therefore, the errors of the duty ratio of the clock signal are canceled. Thus, it is possible to prevent accumulation of the errors of the duty ratio during propagation through the plurality of data driver ICs 16.

However, since a GND signal or a VDD signal is required to be supplied to each data driver IC 16, the construction of the device is complex.

SUMMARY OF THE INVENTION

The present invention is made in view of the above problems, and the object of the present invention is to provide a semiconductor device, a display device, and a signal transmission system which have a simplified construction, and in which errors of the duty ratio are not accumulated.

In order to accomplish the above object, a semiconductor device is provided. The semiconductor device comprises: a first input circuit which receives a first signal supplied from outside; a second input circuit which receives a second signal supplied from outside, in response to the first signal received by the first input circuit; a signal processing circuit which performs signal processing based on the second signal received by the second input circuit; a first output circuit which inverts the first signal received by the first input circuit, and outputs the inverted first signal; and a second output circuit which delays the second signal received by the second input circuit, by a predetermined amount, and outputs the delayed second signal.

In addition, in order to accomplish the above object, a display device is provided. The display device comprises: a display panel; a gate driver which drives gate bus lines of the display panel; and a plurality of data drivers which are cascade-connected, and drive data bus lines of the display panel. Each of the plurality of data drivers includes: a first input circuit which receives a first signal supplied from a preceding stage; a second input circuit which receives a second signal supplied from the preceding stage, in response to the first signal received by the first input circuit; a signal processing circuit which performs signal processing based on the second signal received by the second input circuit; a first output circuit which inverts the first signal received by the first input circuit, and outputs the inverted first signal; and a second output circuit which delays the second signal received by the second input circuit, by a predetermined amount, and outputs the delayed second signal.

Further, in order to accomplish the above object, a signal transmission system including a plurality of semiconductor devices which are cascade-connected, and sequentially transmitting inputted signals is provided. Each of the plurality of semiconductor devices includes: a first input circuit which receives a first signal supplied from a preceding stage; a second input circuit which receives a second signal supplied from the preceding stage, in response to the first signal received by the first input circuit; a signal processing circuit which performs signal processing based on the second signal received by the second input circuit; a first output circuit which inverts the first signal received by the first input circuit, and outputs the inverted first signal; and a second output circuit which delays the second signal received by the second input circuit, by a predetermined amount, and outputs the delayed second signal.

The above and other objects, features and advantages of the present invention will become apparent from the following description when taken in conjunction with the accompanying drawings which illustrate preferred embodiment of the present invention by way of example.

DESCRIPTION OF THE PREFERRED EMBODIMENTS

An embodiment of the present invention is explained below with reference to drawings.

Figure 1:
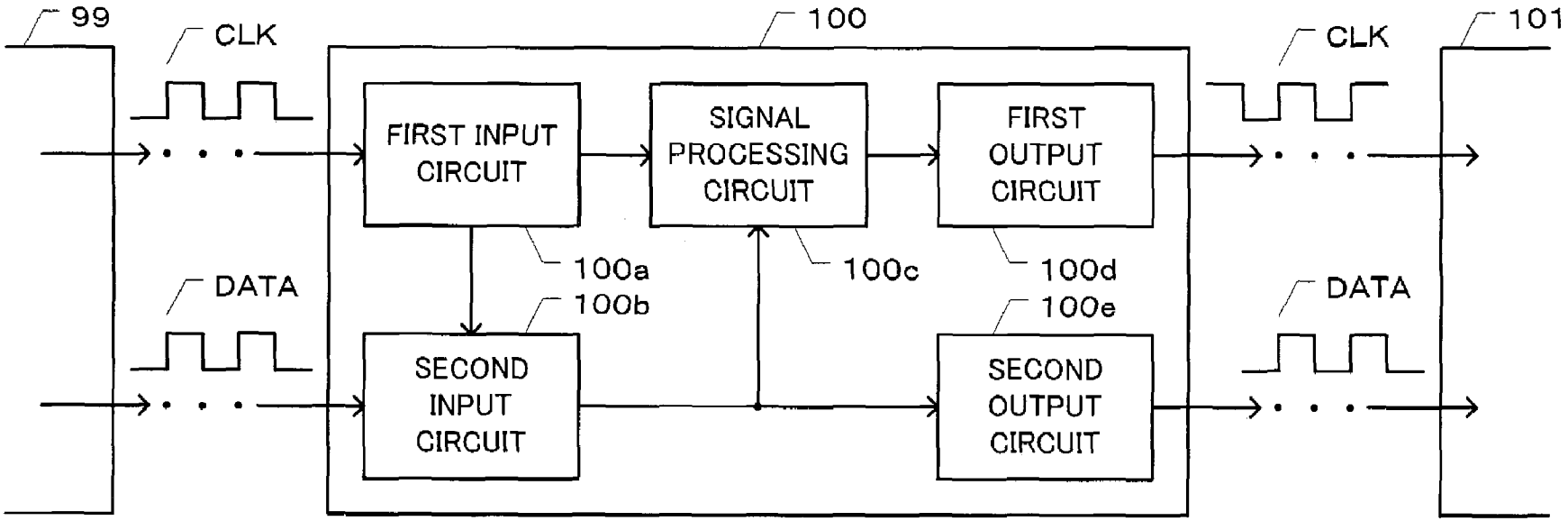
FIG. 1 is a diagram for explaining the principle of the present invention.

FIG. 1 is a diagram for explaining the principle of the present invention. As illustrated in FIG. 1, the semiconductor device 100 is cascade-connected between the semiconductor devices 99 and 101. The semiconductor device 100 receives a clock signal (CLK) and a data signal (DATA) which are outputted from the semiconductor device 99 in the preceding stage, performs predetermined signal processing, and outputs a clock signal and a data signal to the semiconductor device 101 in the following stage.

The semiconductor device 100 comprises a first input circuit 100*a*, a second input circuit 100*b*, a signal processing circuit 100*c*, a first output circuit 100*d*, and a second output circuit 100*e*.

The first input circuit 100*a* receives a clock signal as a first signal supplied from the semiconductor device 99 in the preceding stage.

The second input circuit 100*b* receives a data signal as a second signal supplied from the semiconductor device 99 in the preceding stage, in response to the clock signal (the first signal) supplied from the first input circuit 100*a*.

The signal processing circuit 100*c* performs signal processing based on the data signal (the second signal) supplied from the second input circuit 100*b*.

The first output circuit 100*d* inverts the clock signal (the first signal) supplied from the first input circuit 100*a*, and outputs the inverted clock signal to the semiconductor device 101 in the following stage.

The second output circuit 100*e* delays the data signal (the second signal) supplied from the second input circuit 100*b*, by a half cycle of the clock signal (the first signal).

Next, the operations of the above construction are explained.

The clock signal and the data signal outputted from the semiconductor device 99 in the preceding stage are respectively supplied to the first input circuit 100*a* and the second input circuit 100*b* in the semiconductor device 100.

The first input circuit 100*a* receives the clock signal supplied from the semiconductor device 99 in the preceding stage, and supplies the clock signal to the signal processing circuit 100*c* and the second input circuit 100*b*.

The second input circuit 100*b* receives the data signal in synchronization with the clock signal supplied from the first input circuit 100*a*, and supplies the data signal to the signal processing circuit 100*c* and the second output circuit 100*e*.

The signal processing circuit 100*c* acquires the data signal supplied from the second input circuit 100*b* in synchronization with the clock signal supplied from the first input circuit 100*a*, and performs predetermined processing. In addition, the clock signal is supplied to the first output circuit 100*d*.

The first output circuit 100*d* inverts the clock signal supplied from the signal processing circuit 100*c*, and outputs the inverted clock signal. Thus, a clock signal having a phase which is 180 degrees different from the phase of the clock signal inputted into the semiconductor device 100 is supplied to the semiconductor device 101 in the following stage.

The second output circuit 100*e* delays the data signal supplied from the second input circuit 100*b*, by a half cycle (180 degrees) of the clock signal, and outputs the delayed data signal. Thus, a data signal having a phase which is 180 degrees different from the phase of the data signal inputted into the semiconductor device 100 is supplied to the semiconductor device 101 in the following stage.

Figure 19:
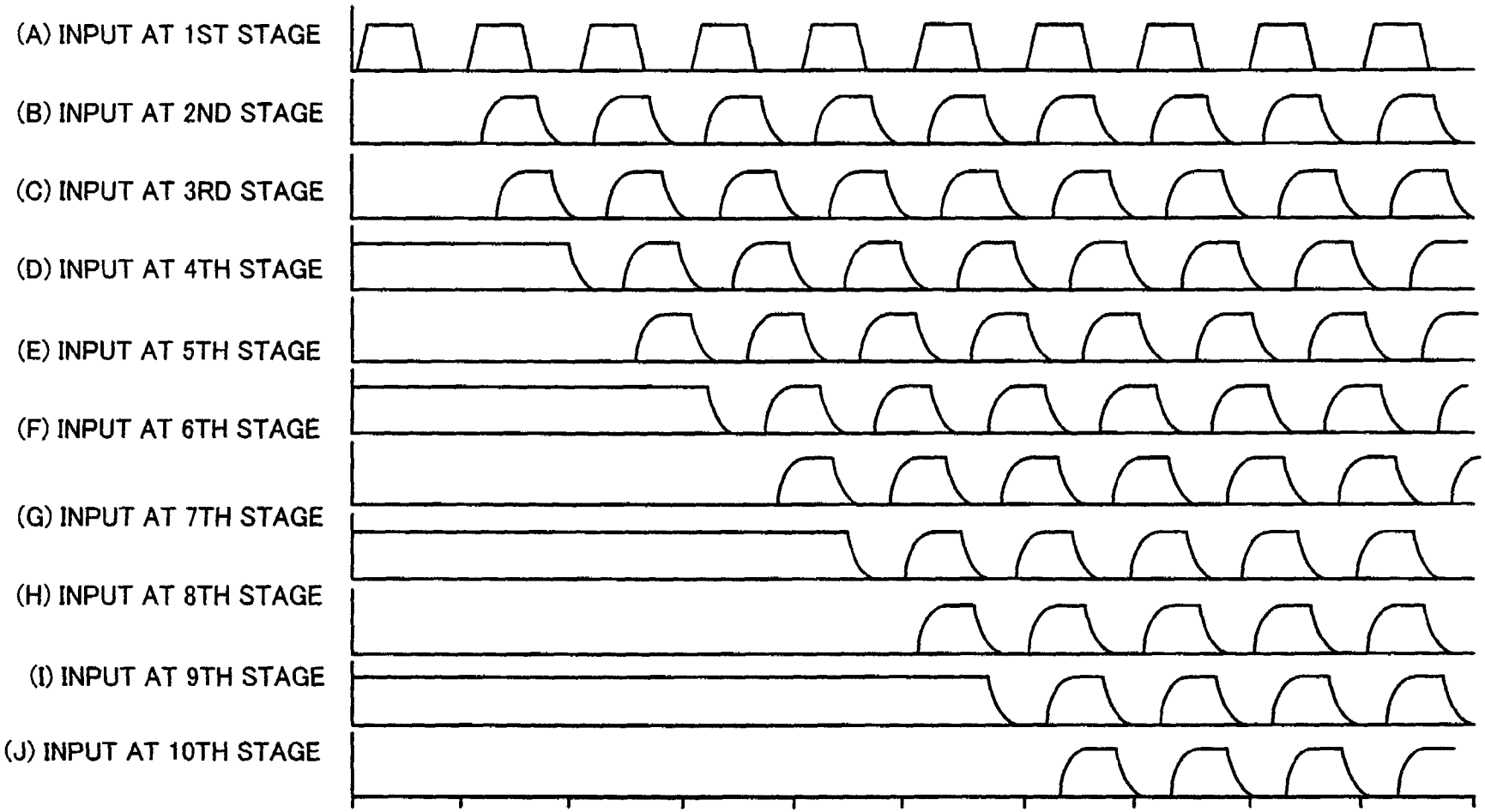
FIG. 19 (PRIOR ART)
FIG. 19 is a timing diagram illustrating the operations of the LCD device disclosed in the Japanese patent application No. 2002-19518.

Since the clock signal inputted through the first output circuit 100*d* is inverted, and is then outputted, even if the duration of the "H" state of the clock signal is elongated, the "H" state is inverted into the "L" state, and is then outputted. Therefore, accumulation of errors of the duty ratio of the clock signal can be prevented in a similar manner to the case explained with reference to FIG. 19.

In addition, since the data signal is also delayed by a half cycle (180 degrees) of the clock signal, and is then outputted, it is possible to bring the data signal into synchronization with the inverted clock signal (i.e., the clock signal the phase of which is 180 degrees different from the phase of the clock signal inputted into the semiconductor device 100). Therefore, it is unnecessary to provide the signal-inversion switch circuits 64 and 69 which are provided in the LCD device proposed by the Japanese patent application No. 2002-19518. Further, it is unnecessary to input the GND signal and the VDD signal according to the positions of the semiconductor devices in the cascade connection.

Thus, according to the present invention, it is possible to simplify the circuit construction, and prevent accumulation of errors of the duty ratio of the clock signal.

Next, an embodiment of the present invention is explained.

Figure 2:
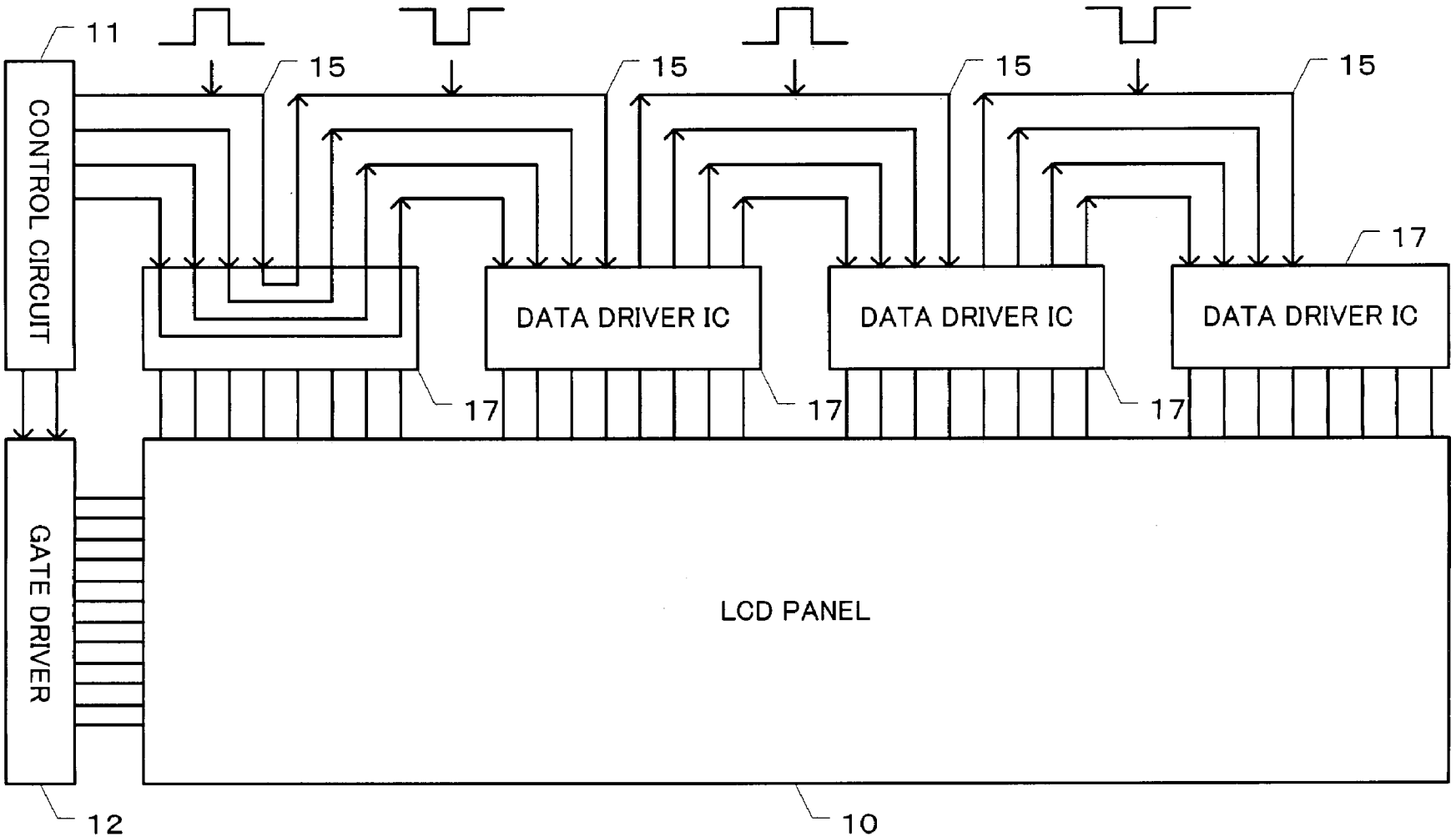
FIG. 2 is a diagram illustrating an exemplary construction of an embodiment of the present invention.

FIG. 2 is a diagram illustrating an exemplary construction of an embodiment of the present invention. The LCD device of FIG. 2 comprises an LCD panel 10, a control circuit 11, a gate driver 12, data driver ICs 17, and signal lines 15.

In the LCD panel 10, pixels each including a transistor (not shown) are arranged in rows and columns, gate bus lines extending from the gate driver 12 in the horizontal direction are connected to gates of the transistors in the pixels, and data bus lines extending from the data driver ICs 17 in the vertical direction are connected to capacitors in the pixels through the transistors. When data is displayed on the LCD panel 10, the gate driver 12 sequentially drives each gate bus line on a line-by-line basis so as to bring transistors connected to the gate bus line into conduction, and then the data driver ICs 17 simultaneously write data through the conducting transistors into pixels on each line in the horizontal direction.

The control circuit 11 is a circuit which controls the gate driver 12 and the data driver ICs 17 so as to display data on the LCD panel 10. Signals outputted from the control circuit 11 are first supplied to the data driver ICs 17 in the first stage, and are then supplied from a data driver IC 17 in each stage to another data driver IC 17 in the following stage.

The gate driver 12 sequentially drives each gate bus line on a line-by-line basis under the control of the control circuit 11 so as to bring transistors connected to the gate bus line into conduction.

The data driver ICs 17 are cascade-connected, and latch data which are supplied from the control circuit 11 and are to be displayed, in synchronization with the clock signal. The data latched by each data driver IC 17 are supplied to the LCD panel 10 and the next data driver IC 17.

Figure 3:
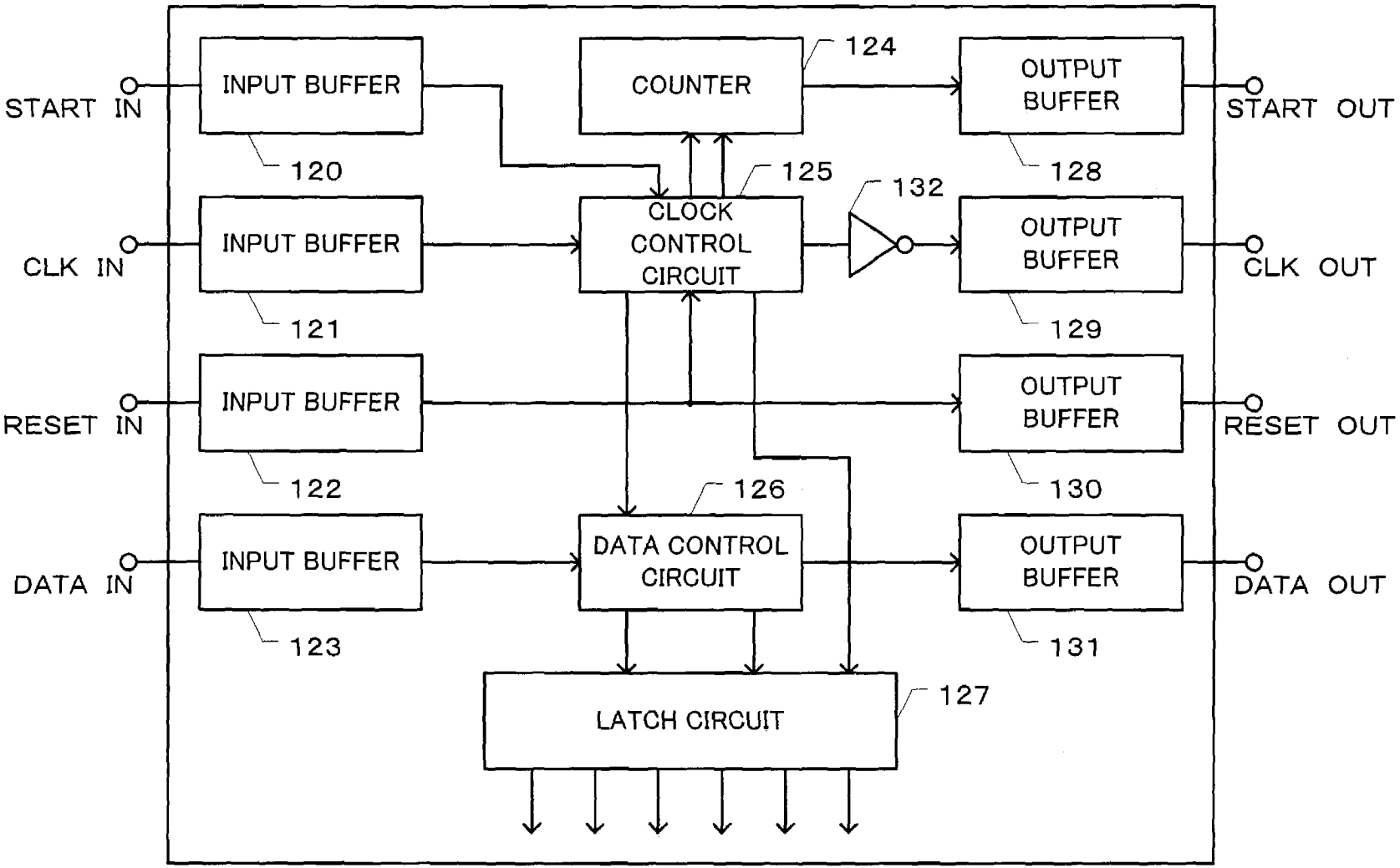
FIG. 3 is a diagram illustrating details of an exemplary construction of a data driver IC in the construction of FIG. 2.

FIG. 3 is a diagram illustrating details of an example of each of the data driver ICs 17. The data driver IC 17 illustrated in FIG. 3 comprises input buffers 120 to 123, a counter 124, a clock control circuit 125, a data control circuit 126, a latch circuit 127, output buffers 128 to 131, and an inverter 132.

A start signal is inputted into the input buffer 120, a clock signal is inputted into the input buffer 121, a reset signal is inputted into the input buffer 122, and a data signal is inputted into the input buffer 123.

The counter 124 counts clock cycles of the clock signal outputted from the clock control circuit 125. When the count reaches a predetermined value, the counter 124 activates a start signal supplied to the output buffer 128.

The clock control circuit 125 controls the counter 124, the data control circuit 126, and the latch circuit 127 in response to the clock signal supplied from the input buffer 121, the start signal, and the reset signal, and supplies the clock signal to the inverter 132.

The data control circuit 126 latches the data signal inputted through the input buffer 123, in synchronization with the clock signal supplied from the clock control circuit 125, and supplies the latched data signal to the latch circuit 127.

The latch circuit 127 latches the data signals supplied from the data control circuit 126, and supplies the latched data signals to the LCD panel 10.

The output buffer 128 supplies the start signal outputted from the counter 124, to the next data driver IC 17.

The output buffer 129 supplies the inverted clock signal outputted from the inverter 132, to the next data driver IC 17.

The output buffer 130 supplies the reset signal outputted from the input buffer 122, to the next data driver IC 17.

The output buffer 131 supplies the data signal outputted from the data control circuit 126, to the next data driver IC 17.

Figure 4:
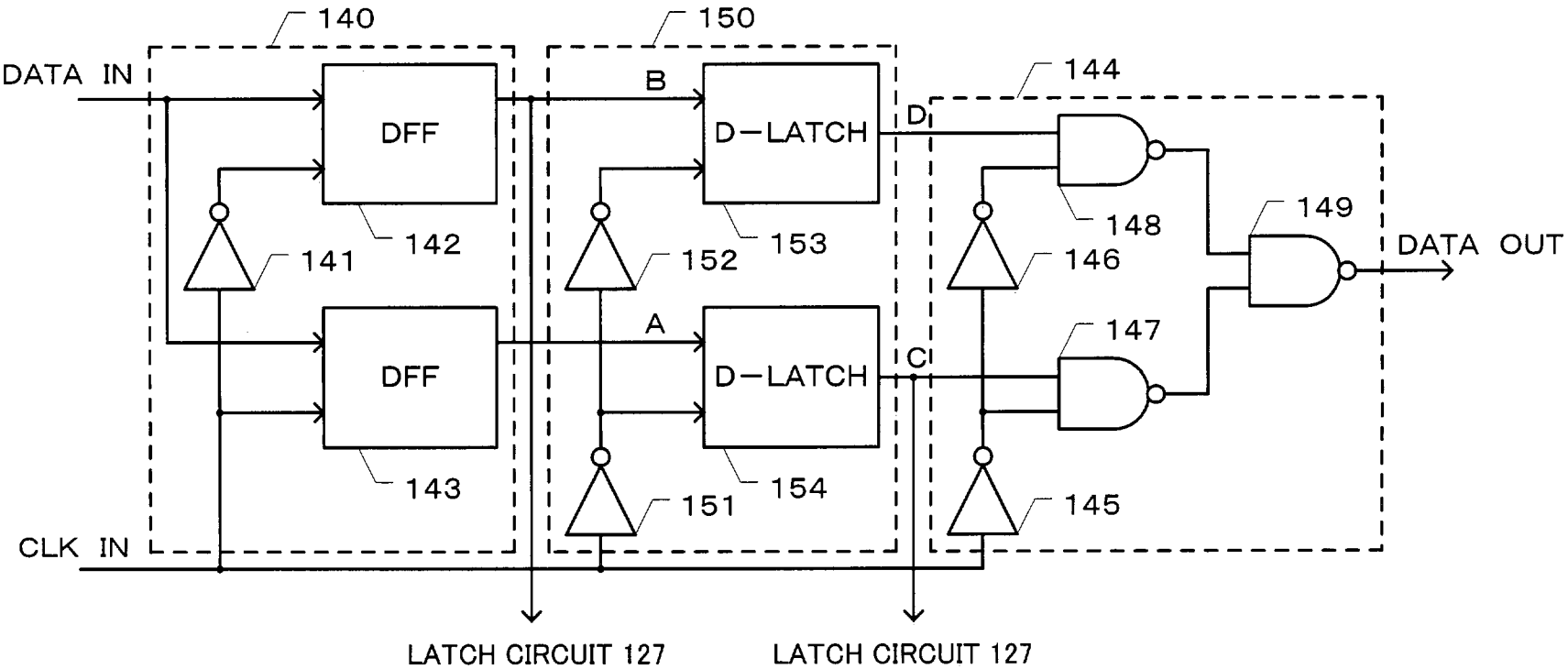
FIG. 4 is a diagram illustrating details of an exemplary construction of a data control circuit in the construction of FIG. 3.

FIG. 4 is a diagram illustrating details of an example of the data control circuit 126. In the example of FIG. 4, the data control circuit 126 is comprised of an input circuit 140, a delay circuit 150, and an output circuit 144, each of which is encircled by dashed lines. The data control circuit 126 latches a data signal in synchronization with a leading edge and a trailing edge of the clock signal, supplies the latched data signals to the LCD panel 10, delays the latched data signals, synthesizes the delayed data signals, and outputs the synthesized data signal.

The input circuit 140 is comprised of an inverter 141 and data flip-flop (DFF) circuits 142 and 143. The DFF 142 latches the data signal in synchronization with a trailing edge of the clock signal, and the DFF 143 latches the data signal in synchronization with a leading edge of the clock signal. The data signals latched by the DFFs 142 and 143 are supplied to the latch circuit 127 and the delay circuit 150.

The delay circuit 150 is comprised of inverters 151 and 152 and D-latch circuits 153 and 154. The D-latch circuit 153 latches the output of the DFF 142 in synchronization with a leading edge of the clock signal, and the D-latch circuit 154 latches the output of the DFF 143 in synchronization with a trailing edge of the clock signal. The data signals latched by the D-latch circuits 153 and 154 are supplied to the latch circuit 127 and the output circuit 144.

The output circuit 144 is comprised of inverters 145 and 146 and NAND gates 147 to 149, synthesizes the data signals outputted from the D-latch circuits 153 and 154 in synchronization with the clock signal, and outputs the synthesized data signal.

Figure 5:
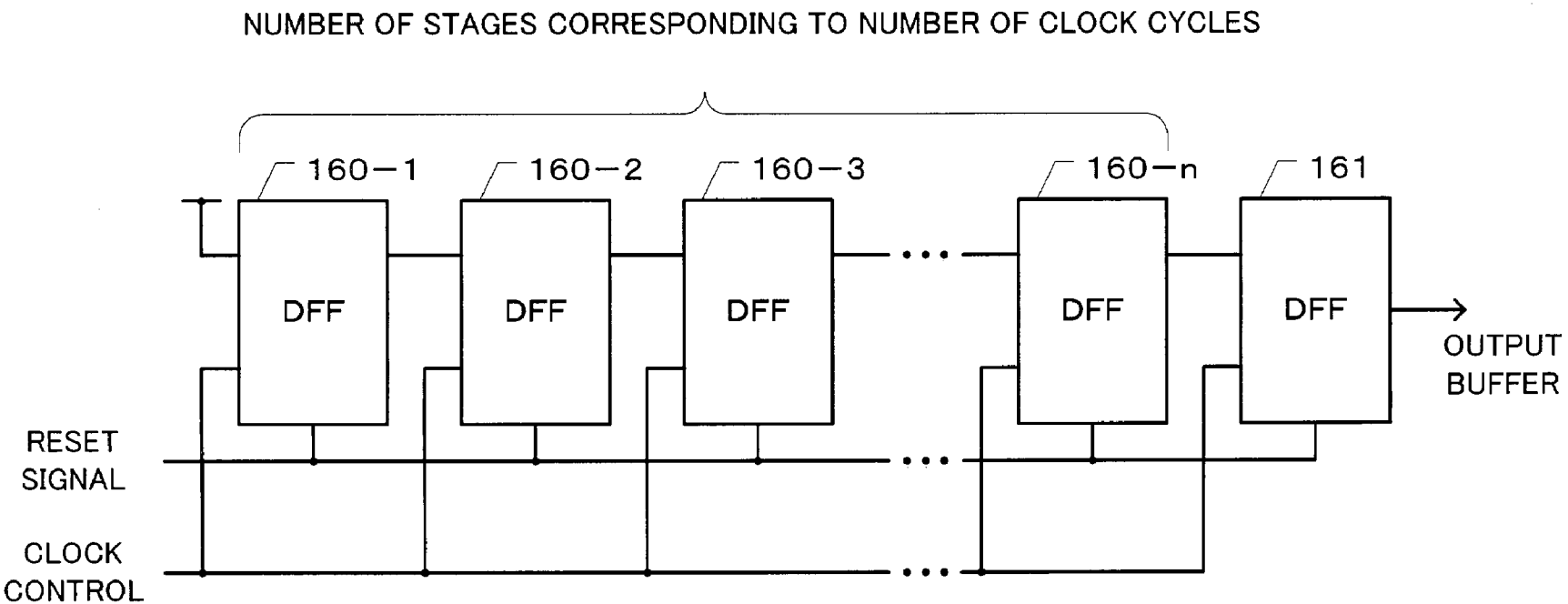
FIG. 5 is a diagram illustrating details of an exemplary construction of a counter in the construction of FIG. 3.

FIG. 5 is a diagram illustrating details of an example of the counter 124. The counter 124 is realized by a shift register constituted by DFFs 160-1 to 160-n and 161, where the number of the DFFs 160-1 to 160-n and 161 corresponds to the number n+1 of clock cycles which are necessary for capture of the data signal. The counter 124 has a function of notifying an IC in the following stage of start timing of capture of a clock signal and a data signal supplied from the stage in which the counter 124 is arranged.

Next, the operations of the above conventional example are explained.

When an image signal is inputted into the control circuit 11, the control circuit 11 outputs a reset signal to be supplied to the data drivers IC 17 in the first stage (illustrated at the left end in FIG. 2).

Each data driver IC 17 reads in the reset signal through the input buffer 122, and resets the clock control circuit 125 and the counter 124. Thereafter, the data driver IC 17 supplies the reset signal to another data driver IC 17 in the next stage. Consequently, the data driver ICs 17 are reset one after another.

Subsequently, when a clock signal and a data signal are outputted from the control circuit 11, the data driver IC 17 in the first stage reads in the clock signal and the data signal through the input buffer 121 and the input buffer 123 (see FIG. 6.(A) and (B)), and supplies the clock signal and the data signal to the clock control circuit 125 and the data control circuit 126, respectively.

Figure 6:
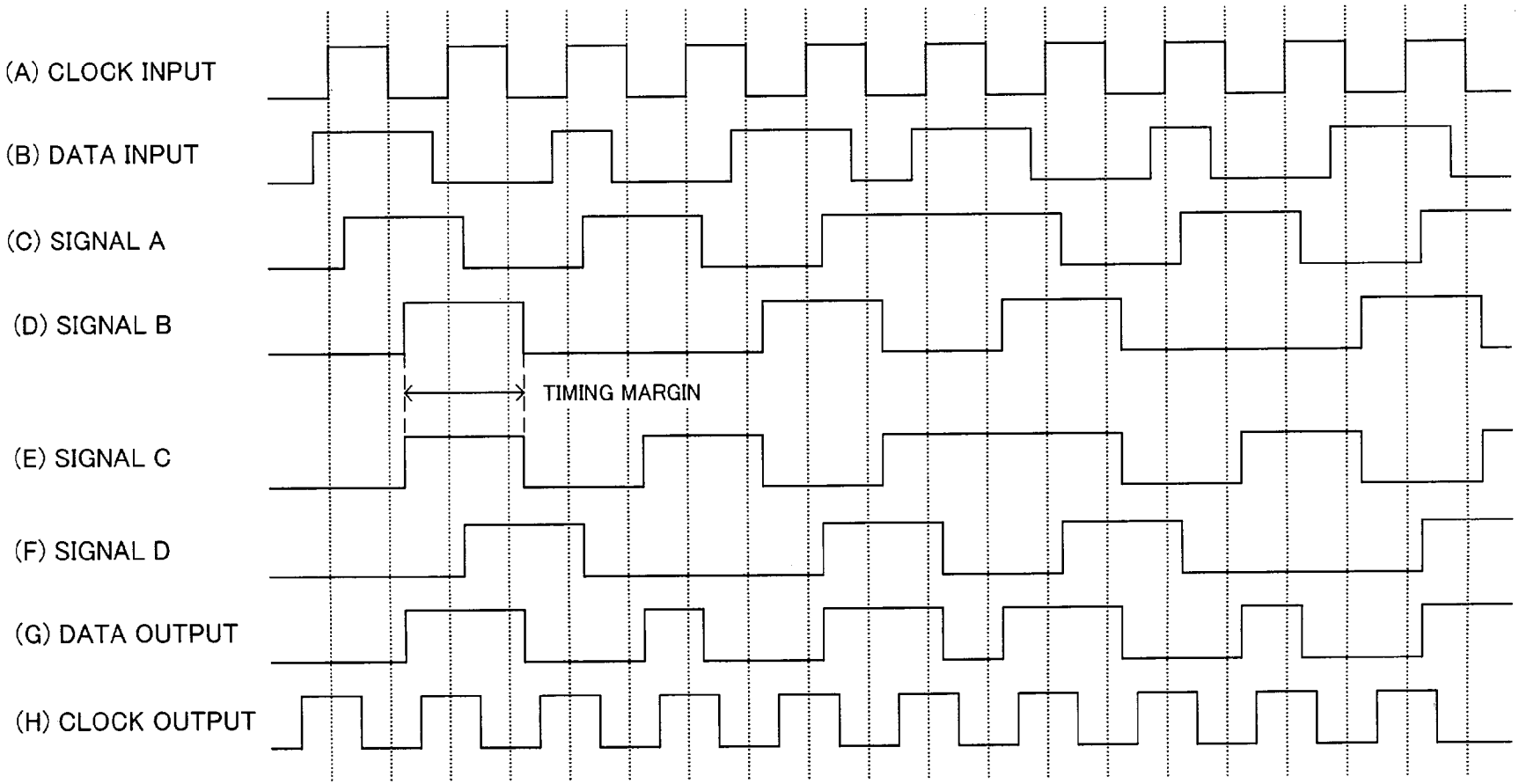
FIG. 6 is a timing diagram for explaining operations of the embodiment illustrated in FIG. 2.

When a start signal is supplied from the control circuit 11 to the input buffer 120, the DFF 143 in the data control circuit 126 latches the data signal in synchronization with a leading edge of the clock signal, and outputs the latched data signal as a signal A (see FIG. 6, (C)) to the D-latch circuit 154. On the other hand, the DFF 142 in the data control circuit 126 latches the data signal in synchronization with a trailing edge of the clock signal, and outputs the latched data signal as a signal B (see FIG. 6, (D)) to the D-latch circuit 153 and the latch circuit 127.

The D-latch circuit 153 delays the output of the DFF 142 by a half cycle of the clock signal by latching the output of the DFF 142 in synchronization with a leading edge of the clock signal, and supplies the delayed output to the output circuit 144 as a signal D (see FIG. 6, (F)).

The D-latch circuit 154 delays the output of the DFF 143 by a half cycle of the clock signal by latching the output of the DFF 143 in synchronization with a trailing edge of the clock signal, and supplies the delayed output to the output circuit 144 and the latch circuit 127 as a signal C (see FIG. 6, (E)).

The output circuit 144 synthesizes the signals outputted from the D-latch circuits 153 and 154 in synchronization with the clock signal, and supplies the synthesized data signal to the output buffer 131.

The latch circuit 127 latches the data signals supplied from the data control circuit 126, and supplies the latched data signals to the LCD panel 10. Thus, image data allocated to the data driver IC 17 are supplied to the LCD panel 10.

After the counter 124 is reset with the reset signal, the counter 124 counts clock cycles of the clock signal. When n cycles of the clock signal elapse, the counter 124 sets the start signal supplied to the output buffer 128, to the "H" state.

The clock signal outputted from the clock control circuit 125 is inverted by the inverter 132, and is then supplied to the output buffer 129.

The output buffers 129 and 131 respectively output to the next data driver IC 17 the clock signal inverted by the inverter 132 and the data signal supplied from the data control circuit 126 (see FIG. 6, (G) and (H)).

The above data signal outputted from the output buffer 131 (see FIG. 6, (G)) is delayed from the data signal inputted into the input buffer 123 (see FIG. 6, (B)) by a half cycle of the clock signal. In addition, since the clock signal inputted through the input buffer 121 is inverted by the inverter 132, the phase of the clock signal is also shifted by 180 degrees.

Figure 7:
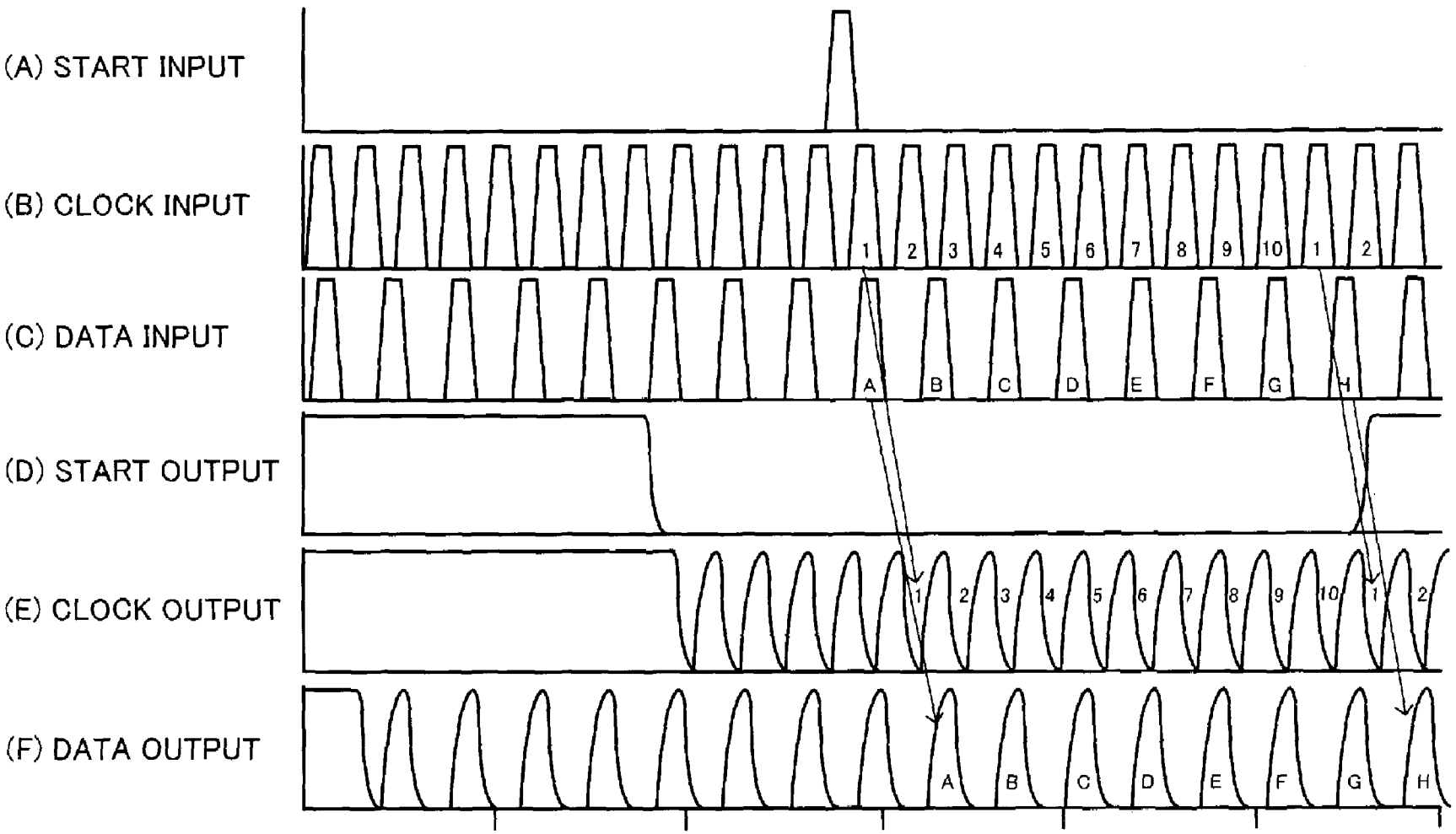
FIG. 7 is a diagram illustrating relationships between phases of a clock signal and data signal.

FIG. 7 is a diagram illustrating relationships between phases of the clock signal and the data signal. In FIG. 7, data bits "A" to "H" are inputted while clock pulses "1" to "10" are inputted. In particular, the data bit "A" is inputted in synchronization with a clock pulse "1."

When the inputted start signal (illustrated by reference (A) in FIG. 7) becomes "H," the data bit "A" (illustrated by reference (C) in FIG. 7) is inputted in synchronization with the clock pulse "1" (illustrated by reference (B) in FIG. 7). As mentioned before, the clock signal is inverted by the inverter 132 before output. Therefore, as illustrated by reference (E) in FIG. 7, the clock pulse "1" is inverted to the "L" state in the outputted clock signal.

On the other hand, since the data signal is delayed by a half cycle of the clock signal before output, as illustrated by reference (F) in FIG. 7, the data bit "A" is outputted in synchronization with the "H" state between the clock pulses "1" and "2." Therefore, the relative phases between the data signal and the clock signal at the input stage into the data driver IC 17 are maintained when they are supplied to the next data driver IC 17.

Figure 8:
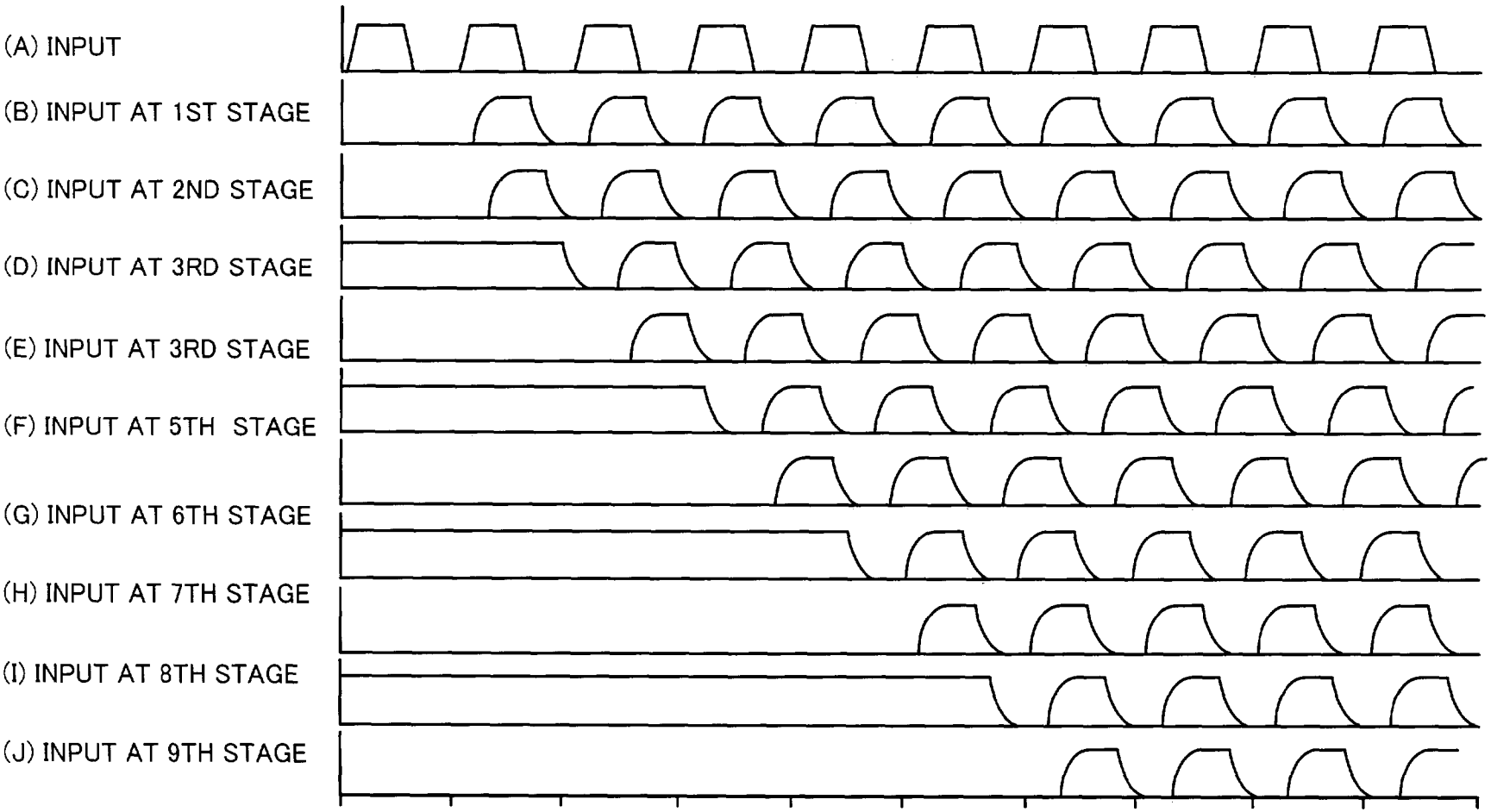
FIG. 8 is a timing diagram illustrating relative phases of a clock signal at the input stages of ten, cascade-connected, data driver ICs illustrated in FIG. 2.
Figure 9:
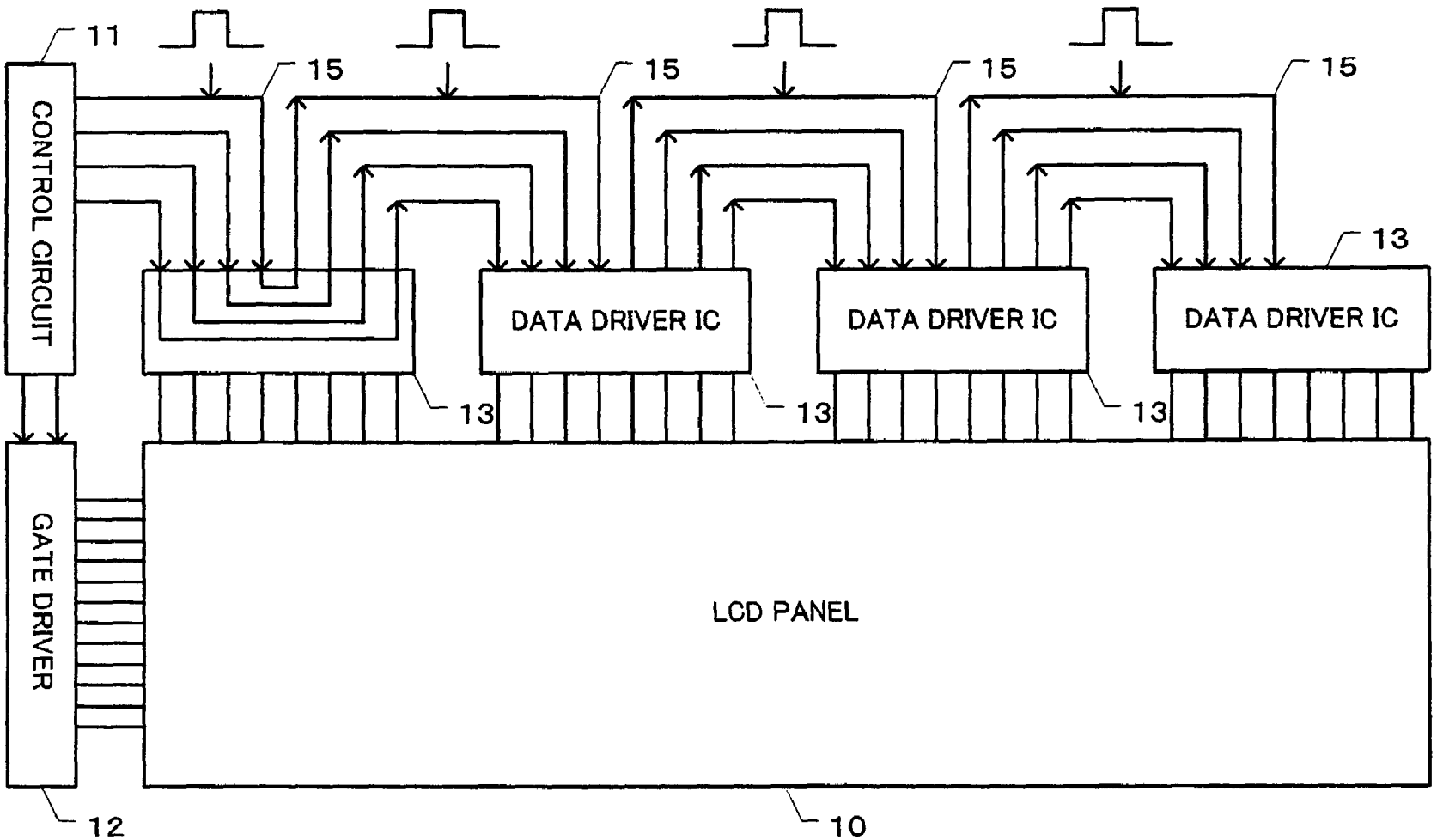
FIG. 9 (PRIOR ART)
FIG. 9 is a diagram illustrating an example of a conventional LCD device having a cascade-connected construction.
Figure 10:
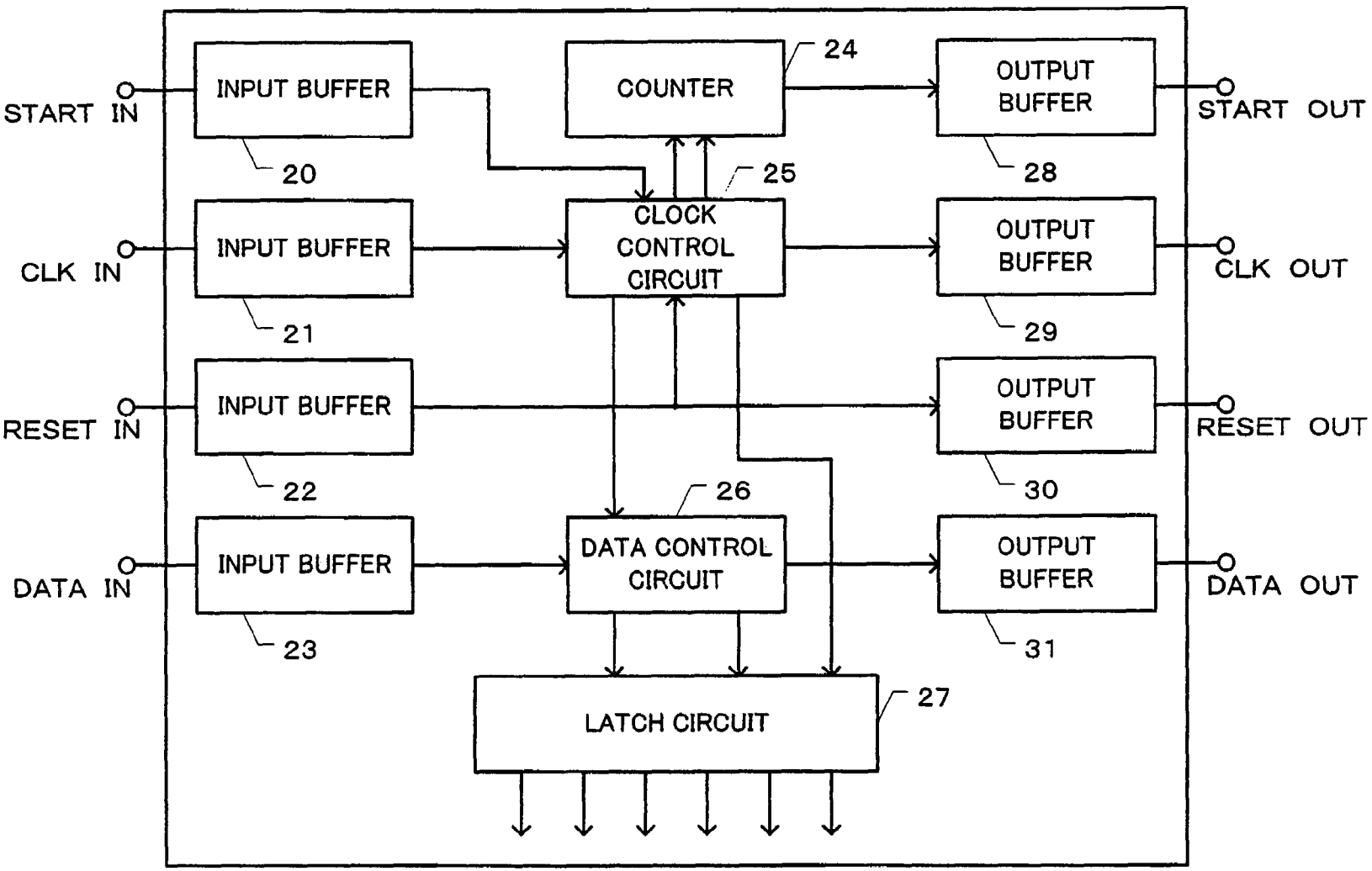
FIG. 10 (PRIOR ART)
FIG. 10 is a diagram illustrating details of an example of each of the data driver ICs.

FIG. 8 is a timing diagram illustrating relative phases of the clock signal at the input stages of ten, cascade-connected, data driver ICs illustrated in FIG. 2. In FIG. 8, references (A) to (J) indicate waveforms of the clock signal at the input stages of the data driver ICs 17 in the first to tenth stages (although only four stages are illustrated in FIG. 2). As illustrated in FIG. 8, in the embodiment of the present invention, the clock signal is inverted in each data driver IC 17 before output. Therefore, it is possible to prevent accumulation of the errors of the duty ratio.

Figure 11:
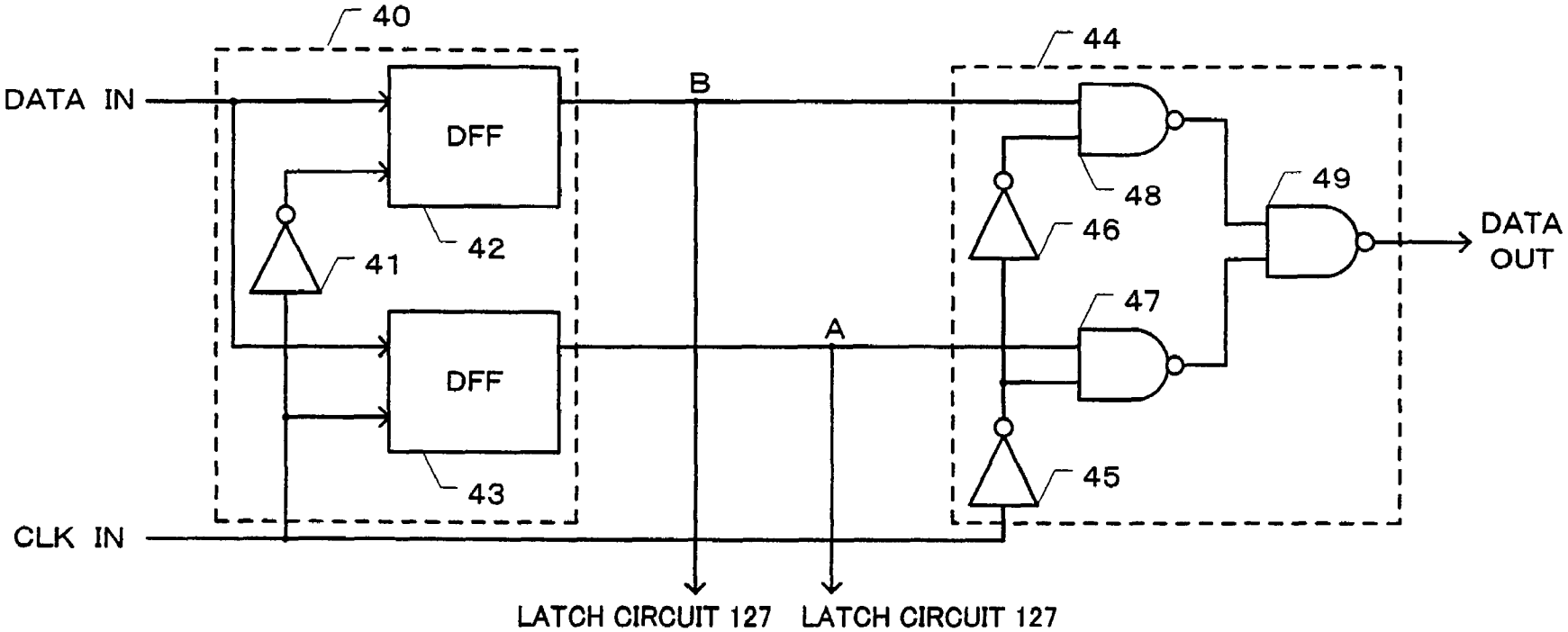
FIG. 11 (PRIOR ART)
FIG. 11 is a diagram illustrating details of an example of the data control circuit.
Figure 12:
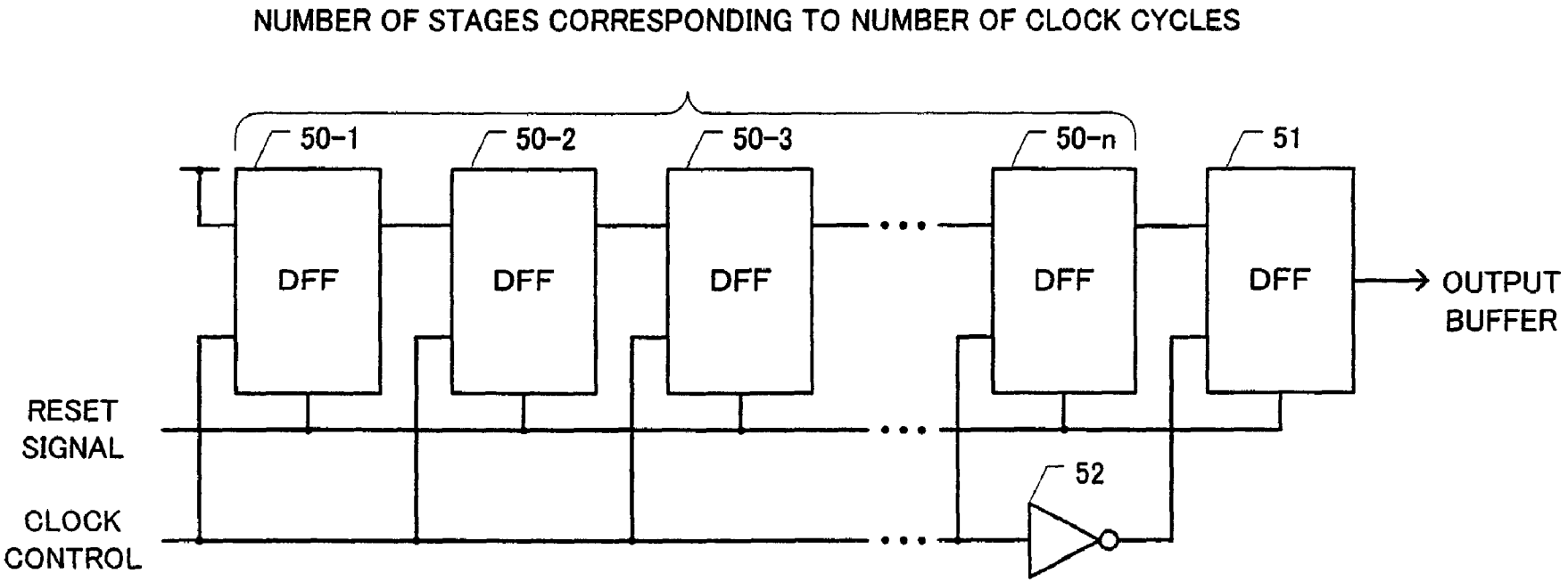
FIG. 12 (PRIOR ART)
FIG. 12 is a diagram illustrating details of an example of the counter.
Figure 13:
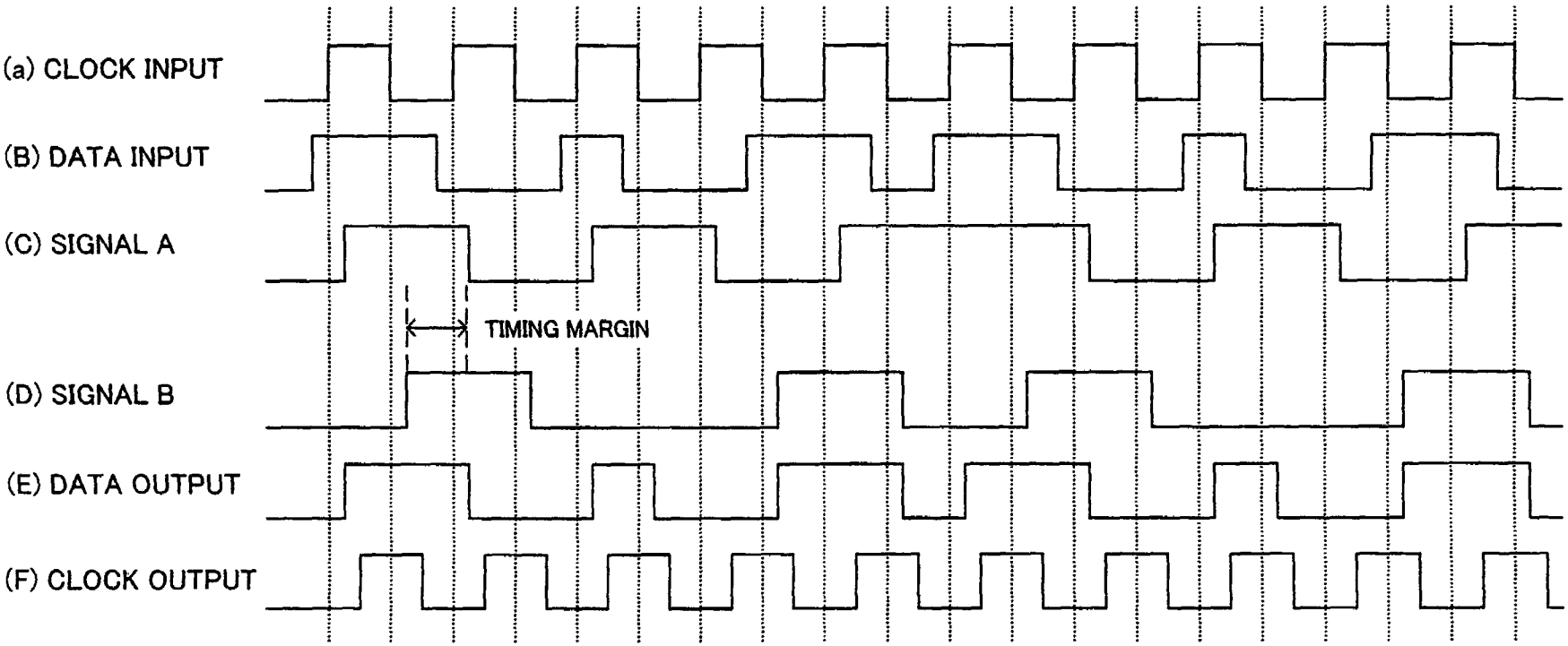
FIG. 13 (PRIOR ART)
FIG. 13 is a timing diagram illustrating the operations of the data driver IC and the data control circuit.
Figure 14:
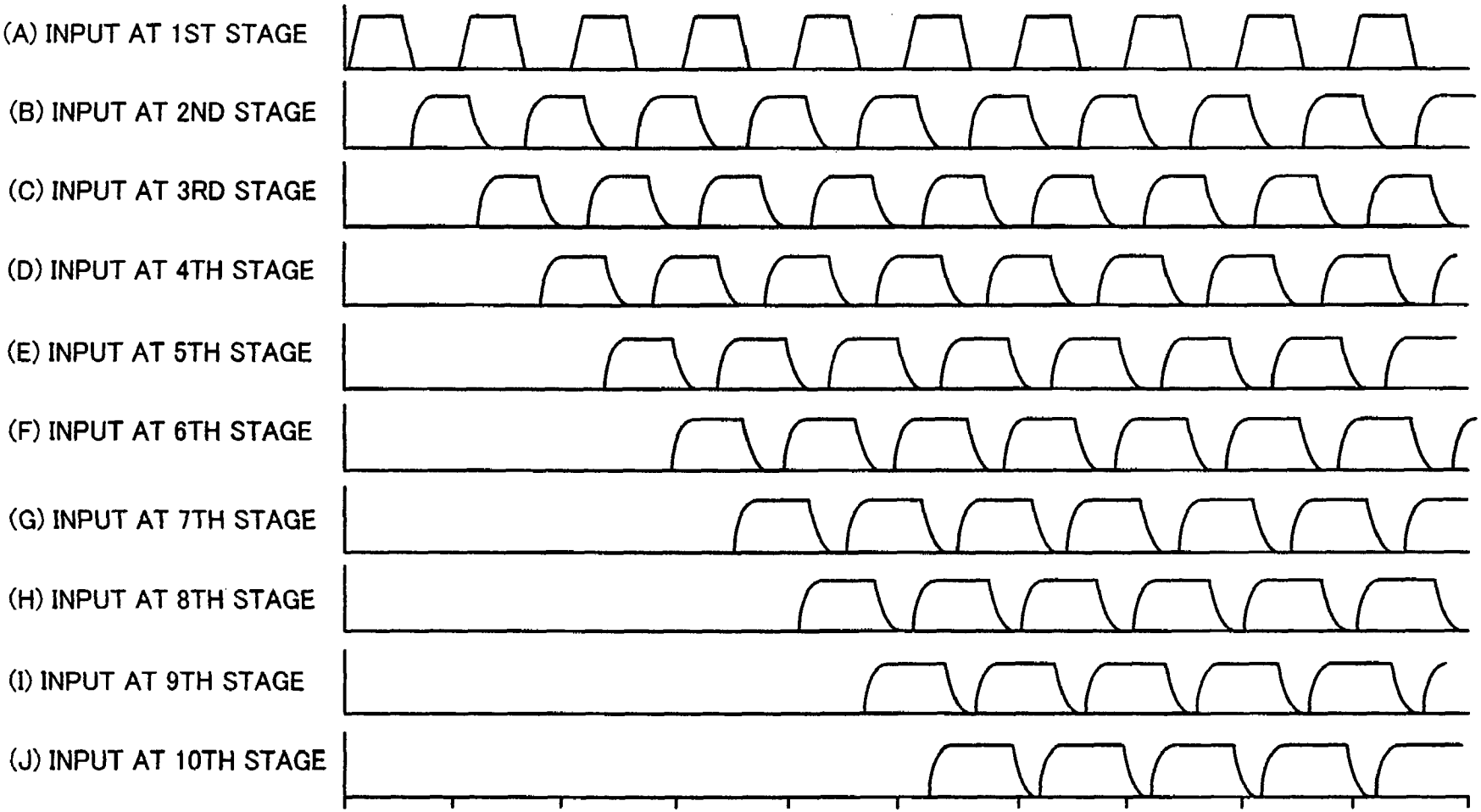
FIG. 14 (PRIOR ART)
FIG. 14 is a timing diagram illustrating waveforms of a clock signal at the input stages of ten, cascade-connected, data driver ICs.
Figure 15:
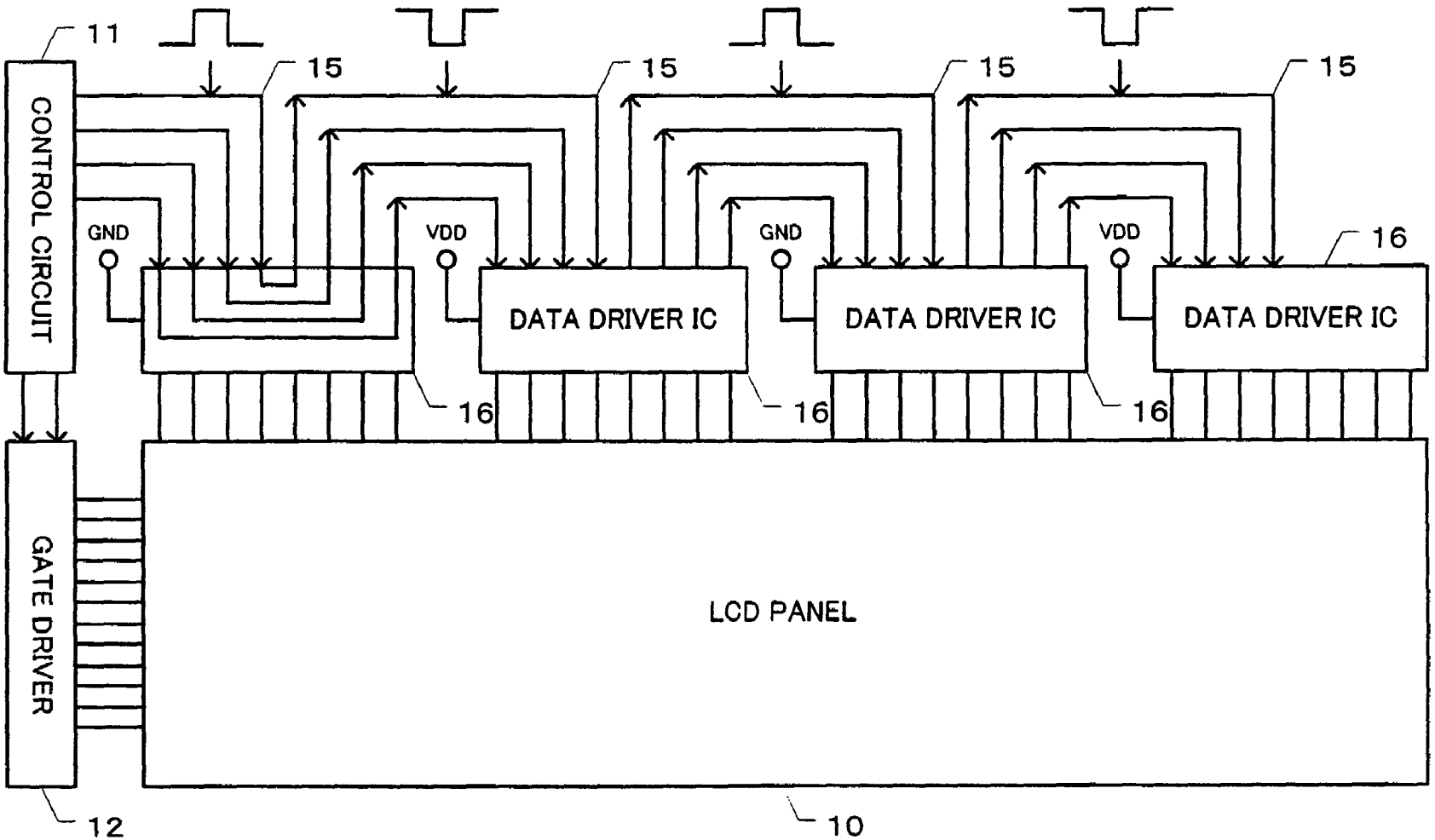
FIG. 15 (PRIOR ART)
FIG. 15 is a diagram illustrating details of the LCD device proposed by the Japanese patent application No. 2002-19518.
Figure 16:
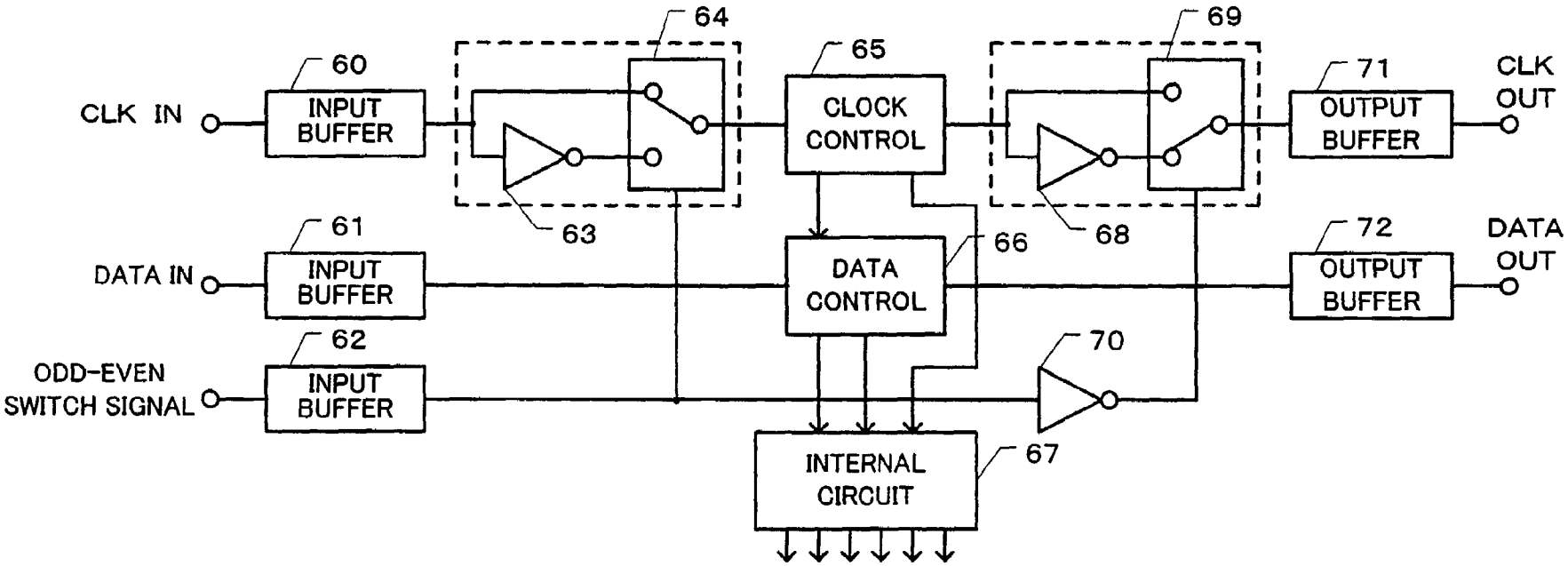
FIG. 16 (PRIOR ART)
FIG. 16 is a diagram illustrating details of a construction of each data driver IC in the construction of FIG. 15.
Figure 17:
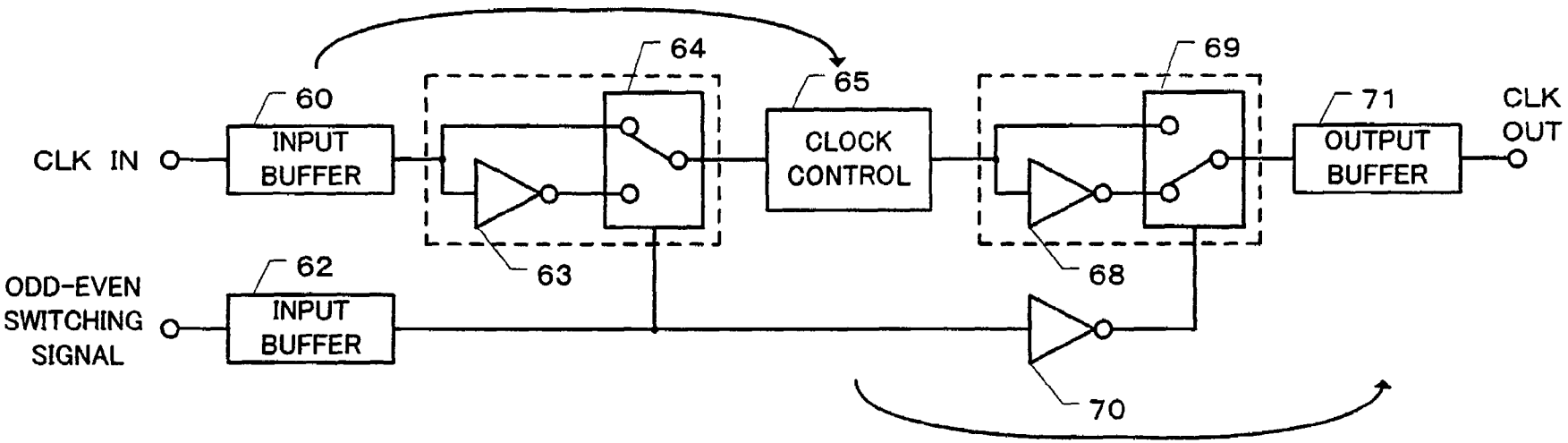
FIG. 17 (PRIOR ART)
FIG. 17 is a diagram illustrating the connection state in each of the odd-numbered data driver ICs in the cascade connection.
Figure 18:
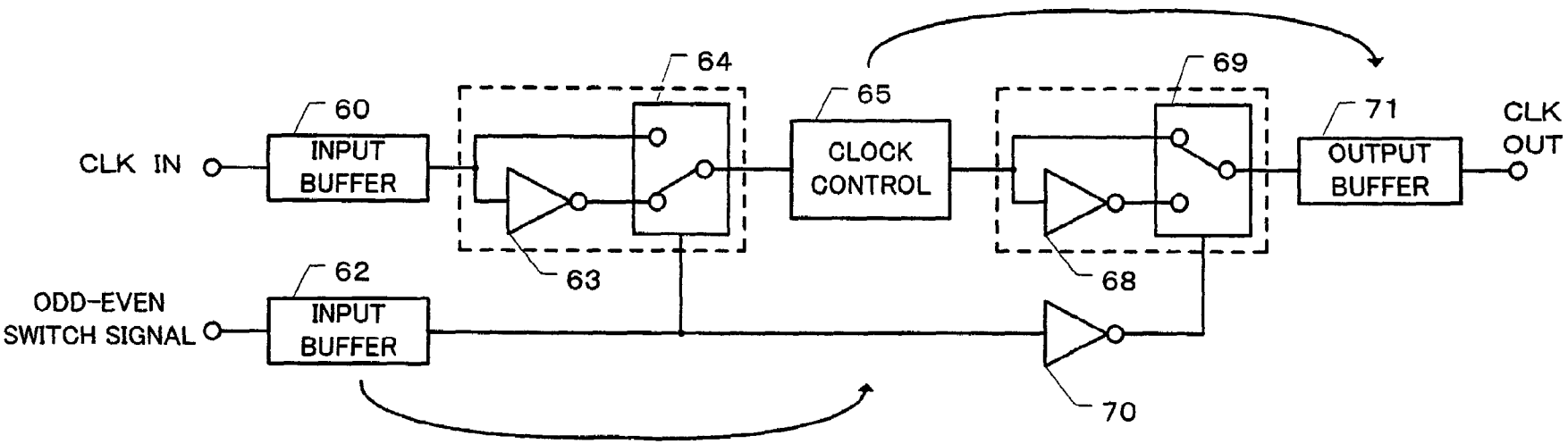
FIG. 18 (PRIOR ART)
FIG. 18 is a diagram illustrating the connection state in each of the even-numbered data driver ICs in the cascade connection.

In the conventional data control circuit illustrated in FIG. 11, information carried by the data signal is captured in synchronization with a leading edge and a trailing edge of the clock signal by latching input signals of the DFFs 42 and 43, respectively. However, in the conventional construction, as illustrated in FIG. 13, the timing margin for the latch circuit 127 to latch data is as small as the time from a trailing edge of each clock pulse to a leading edge of the following clock pulse. Therefore, when the resolution becomes high, it is impossible to normally capture data.

On the other hand, in the embodiment of the present invention, as illustrated in FIG. 4, the output (the signal C) of the D-latch circuit 154 is used for obtaining information carried by the outputted data signal at each leading edge, and the output (the signal B) of the DFF 142 is used for obtaining information carried by the outputted data signal at each trailing edge as in the conventional construction. Therefore, as illustrated in FIG. 6, it is possible to obtain as a time margin the time from each trailing edge to the next trailing edge of the clock signal. Therefore, it is possible to accurately latch data even when the image resolution becomes high.

Although the data signal is delayed by using the D-latch circuits 153 and 154 in the above embodiment, alternatively, it is possible to use delay lines for delaying the data signal.

Although, the above explanation of the embodiment takes an example in which an LCD panel is used, the present invention can be applied to other display devices such as a device using a plasma display panel.

Applications of the present invention are not limited to display devices such as the LCD device. The present invention can also be applied to a transmission system in which signals are transmitted between cascade-connected semiconductor devices.

The circuits in the above embodiment are illustrated only as examples. The present invention is not limited to such circuits.

As explained above, according to the present invention, in each of cascade-connected semiconductor devices, a first signal which is supplied from outside is inverted before output, and a second signal which is also supplied from outside is delayed by a predetermined amount before output. Therefore, it is possible to prevent accumulation of errors of the duty ratio of the first signal.

In addition, according to the present invention, in each of a plurality of cascade-connected data drivers in a display device, a first signal which is supplied from a preceding stage is inverted before output, and a second signal which is also supplied from the preceding stage is delayed by a predetermined amount before output. Therefore, it is possible to prevent accumulation of errors of the duty ratio of the first signal and quality deterioration of displayed images.

Further, according to the present invention, in each of a plurality of cascade-connected semiconductor devices in a signal transmission system, a first signal which is supplied from a preceding stage is inverted before output, and a second signal which is also supplied from the preceding stage is delayed by a predetermined amount before output. Therefore, it is possible to prevent accumulation of errors of the duty ratio of the first signal and quality deterioration of transmitted signals.

The foregoing is considered as illustrative only of the principle of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A semiconductor device comprising:

a first input circuit which receives only one clock signal supplied from outside;

a second input circuit which receives a data signal supplied from outside, in response to said clock signal received by said first input circuit;

a signal processing circuit which performs signal processing based on said data signal received by said second input circuit;

a first output circuit which inverts said clock signal received by said first input circuit, and outputs the inverted clock signal; and a second output circuit which delays said data signal received by said second input circuit by a half cycle of the clock signal, and outputs the delayed data signal only in response to said clock signal, wherein said second output circuit delays said data signal by using a latch circuit, and wherein said data signal carries a pair of information pieces at positions corresponding to a leading edge and a trailing edge of said clock signal, said signal processing circuit captures a preceding one of said pair of information pieces from the data signal after said preceding one of said pair of information pieces is output from a delay circuit, and a following one of said pair of information pieces from the data signal before said following one of said pair of information pieces is input to said delay circuit.

2. The semiconductor device according to claim 1, further comprising, a third input circuit which receives a start signal indicating capture of said data signal, and a third output circuit which delays said start signal received by said third input circuit, by a number of cycles of said clock signal which are necessary for capture of said data signal.

3. The semiconductor device according to claim 1, wherein at least one of said first and second output circuits delays said data signal by using a delay line.

4. A display device comprising:

a display panel;

a gate driver which drives gate bus lines of said display panel; and a plurality of data drivers which are cascade-connected, and drive data bus lines of said display panel;

each of said plurality of data drivers includes, a first input circuit which receives only one clock signal supplied from a preceding stage, a second input circuit which receives a data signal supplied from the preceding stage, in response to said clock signal received by said first input circuit, a signal processing circuit which performs signal processing based on said data signal received by said second input circuit, a first output circuit which inverts said clock signal received by said first input circuit, and outputs the inverted clock signal, and a second output circuit which delays said data signal received by said second input circuit by a half cycle of the clock signal, and outputs the delayed data signal only in response to said clock signal, wherein said second output circuit delays said data signal by using a latch circuit, and wherein said data signal carries a pair of information pieces at positions corresponding to a leading edge and a trailing edge of said clock signal, said signal processing circuit captures a preceding one of said pair of information pieces from the data signal after said preceding one of said pair of information pieces is output from a delay circuit, and a following one of said pair of information pieces from the data signal before said following one of said pair of information pieces is input to said delay circuit.

5. The display device according to claim 4, further comprising, a third input circuit which receives a start signal indicating capture of said data signal, and a third output circuit which delays said start signal received by said third input circuit, by a number of cycles of said clock signal which are necessary for capture of said data signal.

6. The display device according to claim 4, wherein at least one of said first and second output circuits delays said data signal by using a delay line.

7. A signal transmission system including a plurality of semiconductor devices which are cascade-connected, and sequentially transmitting inputted signals, wherein each of said plurality of semiconductor devices includes:

a first input circuit which receives only one clock signal supplied from a preceding stage;

a second input circuit which receives a data signal supplied from the preceding stage, in response to said clock signal received by said first input circuit;

a signal processing circuit which performs signal processing based on said data signal received by said second input circuit;

a first output circuit which inverts said clock signal received by said first input circuit, and outputs the inverted clock signal; and a second output circuit which delays said data signal received by said second input circuit by a half cycle of the clock signal, and outputs the delayed data signal only in response to said clock signal, wherein said second output circuit delays said data signal by using a latch circuit, and wherein said data signal carries a pair of information pieces at positions corresponding to a leading edge and a trailing edge of said clock signal, said signal processing circuit captures a preceding one of said pair of information pieces from the data signal after said preceding one of said pair of information pieces is output from a delay circuit, and a following one of said pair of information pieces from the data signal before said following one of said pair of information pieces is input to said delay circuit.

* * * * *